US007025334B2

(12) United States Patent
Ehrenleitner

(10) Patent No.: US 7,025,334 B2
(45) Date of Patent: Apr. 11, 2006

(54) LIFTING DEVICE

(75) Inventor: Franz Ehrenleitner, Stuttgart (DE)

(73) Assignee: Eisenmann Maschinenbau KG, (DE)

( * ) Notice: Subject to any disclaimer, the term of this patent is extended or adjusted under 35 U.S.C. 154(b) by 0 days.

(21) Appl. No.: 10/710,203

(22) Filed: Jun. 25, 2004

(65) Prior Publication Data

US 2005/0023512 A1 Feb. 3, 2005

(30) Foreign Application Priority Data

Jun. 25, 2003 (DE) ..... 103 28 486

(51) Int. Cl.
*B66D 1/26* (2006.01)

(52) U.S. Cl. ..... 254/278

(58) Field of Classification Search ..... 254/278, 254/371–374; 242/530.1, 530.2
See application file for complete search history.

(56) References Cited

U.S. PATENT DOCUMENTS

| | | | | |
|---|---|---|---|---|
| 2,497,220 A * | 2/1950 | Humberson | | 226/193 |
| 3,135,478 A | 6/1964 | Harlander | | |
| 3,402,589 A * | 9/1968 | Lathom | | 72/289 |
| 4,008,863 A | 2/1977 | Fohl | | |
| 4,252,298 A * | 2/1981 | Fitch | | 254/371 |
| 4,305,554 A | 12/1981 | Anderson | | |
| 4,491,301 A | 1/1985 | Pendola | | |
| 5,346,153 A | 9/1994 | Ebey | | |
| 5,792,294 A * | 8/1998 | Randazzo et al. | | 156/94 |
| 5,957,433 A * | 9/1999 | Fujikawa et al. | | 254/371 |
| 6,073,917 A * | 6/2000 | Plummer | | 254/389 |
| 6,386,324 B1 * | 5/2002 | Baranda et al. | | 187/254 |
| 6,390,242 B1 * | 5/2002 | Baranda et al. | | 187/254 |
| 6,401,871 B1 * | 6/2002 | Baranda et al. | | 187/254 |

FOREIGN PATENT DOCUMENTS

| | | |
|---|---|---|
| DE | 3407504 C2 | 6/1986 |
| EP | 0 824 085 | 2/1998 |

* cited by examiner

*Primary Examiner*—Emmanuel Marcelo
(74) *Attorney, Agent, or Firm*—Factor & Lake

(57) ABSTRACT

A lifting device for raising and lowering a load comprises in a known manner a lifting drum that can be driven in both directions of rotation, as well as at least one belt serving as traction mechanism that is secured to one end of the lifting drum and carries at the other end a holding device for the load. The belt can be wound on the lifting drum by rotation of the latter, in such a way that the windings come to lie on top of one another. In order to reduce repeated mechanical stress reversals at the step that is formed by the end of the belt secured to the circumferential wall of the lifting drum, at least one spacing element is arranged on the circumferential wall of the lifting drum, against which element rests the first winding of the belt.

7 Claims, 4 Drawing Sheets

LIFTING DEVICE

SUMMARY OF INVENTION

The present invention relates to a lifting device for raising and lowering a load, with:

a) a lifting drum;

b) a drive by means of which the lifting drum can be caused to rotate in both directions; and c) at least one belt serving as traction mechanism, which is secured at one end to the lifting drum and at the other end carries a device for holding the load, wherein:

d) the belt can by rotation of the lifting drum be wound onto the latter so that the windings come to lie on top of one another.

Lifting devices that operate with a lifting drum and at least one flexible traction mechanism that can be wound on this lifting drum are known in a very wide range of designs and modifications. In particular ropes, chains or belts are used as traction mechanisms. Belts have the advantage that they can be wound in a particularly well-defined manner on the lifting drum and their load-carrying capacity is relatively large, while at the same time they remain sufficiently flexible. For this reason lifting devices using belts as traction mechanisms, which is also the subject matter of the present invention, are enjoying increasing popularity.

With such lifting devices known on the market it has been found however that the repeated mechanical stress reversals of the belts when wound onto the lifting drum and unwound from the lifting drum is still relatively large.

The object of the present invention is to design a lifting device of the type mentioned in the introduction so that the belt is subjected to a lesser mechanical loading.

This object is achieved in accordance with the invention in that:

d) on the circumferential wall of the lifting drum there is arranged at least one spacing element on which rests the first winding of the belt.

The invention is based on the following knowledge: by means of the end of the belt secured to the circumferential wall of the lifting drum a step is formed for the second winding of this belt at the site of this end. Between the lower side of the first winding and the circumferential surface an empty space is accordingly formed in that circumferential region that lies in front of the step. In particular under the action of a load the belt is partially forced into this empty space, whereby it experiences a kink at the step formed by the end of the belt. This kink leads under unfavorable conditions to a repeated stress reversal of the belt, which shortens its useful life. Due to the spacing element provided according to the invention the forcing of the belt into the aforementioned empty space is prevented or at least reduced so that no, or no unallowably large, kink is produced at the step formed by the end of the belt, and in this way the repeated mechanical stress reversal can be kept small.

Ideally the course of the thickness of the spacing element in the circumferential direction is matched to the geometrical shape of the intermediate space so that thereby the belt in the circumferential direction is supported everywhere by the spacing element. This means that the thickness of the spacing element must increase in that circumferential direction of the lifting drum that is opposite to the direction of rotation of the lifting drum when raising the load.

The spacing element need not necessarily extend in the circumferential direction over the whole angular range in which an intermediate space exists between the first winding and the circumferential surface of the lifting device. In many cases it is sufficient if the belt is supported only over a certain stretch by the spacing element. The belt can bridge smaller intermediate spaces in a self-supporting manner. In this connection, under favorable circumstances a single spacing element may be sufficient. If this is not the case, then a plurality of spacing elements may be arranged next to one another in the circumferential direction of the lifting drum, wherein the mean thickness of the spacing elements increases in that circumferential direction of the lifting drum that is opposite to the direction of rotation of the lifting drum when raising the load.

In general it is also sufficient if the spacing element has a constant thickness. This then means more particularly that the belt either does not rest at all points against the spacing element, or to some extent is pressed inwardly onto the spacing element. This however can be tolerated and does not damage the belt.

The present invention is particularly important in those cases where a plurality of belts are provided that can be wound on top of one another on the lifting drum. The thicknesses of these belts in fact add up to that of the step that is formed there, where the ends of the belts are secured to the lifting drum.

Lifting devices of the type mentioned in the introduction generally have a counterbalance weight that is carried by a belt that is wound on the lifting drum in a direction of rotation that is opposite to the direction of rotation in which the load-carrying belt is wound onto the lifting drum. The size of the counterbalance weight is chosen as far as possible to be the same as the load, so that the torques that are exerted on the lifting drum by the load on the one hand and by the counterbalance weight on the other hand compensate one another as far as possible. In this case the torque that in addition has to be contributed by the drive mechanism when raising the load is correspondingly small. With this design of the lifting device it is expedient also to provide on the circumferential surface of the lifting drum at least one spacing element for the belt carrying the counterbalance weight.

The advantages that can be achieved with the invention are particularly manifested in the case where the belt is made of metal, in particular of steel.

BRIEF DESCRIPTION OF DRAWINGS

Examples of implementation of the invention are described in more detail hereinafter with the aid of the drawings, in which.

DETAILED DESCRIPTION

Figure 1:
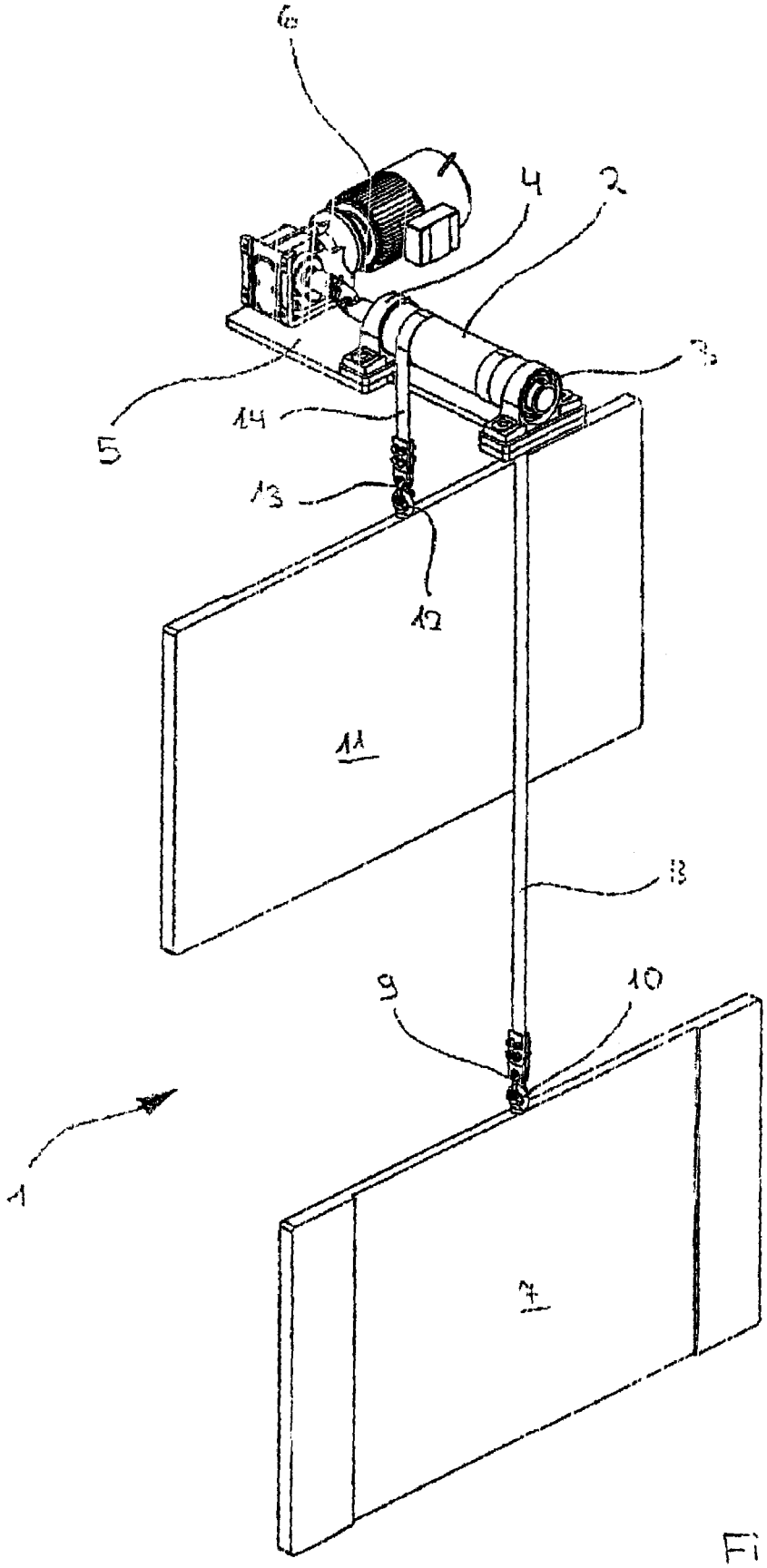
FIG. 1 shows diagrammatically in a perspective view a very simple embodiment of a lifting device.

The lifting device shown in perspective in FIG. 1 and identified overall by the reference numeral 1 comprises a lifting drum 2, which for its part is rotatably mounted via pillow blocks 3, 4 on an installation platform 5. The lifting drum 2 can be rotated in both directions by means of an electric gear-type motor 6, which is likewise secured on the installation platform 5. The installation platform 5 is arranged at a certain height above the floor, for example by means of a steel construction (not shown for reasons of clarity).

A load diagrammatically illustrated as a plate or slab 7 is suspended from the lifting drum 2 by means of a steel belt The steel belt 8 has for this purpose at its lower end a snap hook 9 that can be inserted into a carrying eye 10 of the load 7. The upper end of the steel belt 8 is secured to the lifting drum 2. On rotation of the lifting drum 2 the steel belt 8 is thus wound onto the lifting drum 2 in the form of windings lying more or less on top of one another, or depending on the direction of rotation, is unwound from this drum.

A counterbalance weight 11, which is likewise formed as a plate or slab, is connected via a carrying eye 12 to a snap hook 13 that is secured to the lower end of a second steel belt 14 wound on the lifting drum 2. The steel belt 14 is wound round the lifting drum 2 in the opposite direction to the load-carrying steel belt 8 and is secured at its upper end to the said drum. The arrangement obviously operates in such a way that the counterbalance weight 11 falls when the load 7 is raised, and vice versa. The counterbalance weight 11 exerts a torque on the lifting drum 2 that is roughly opposite to the torque exerted by the load 7, with the result that the electric gear-type motor 6 has to perform only a small amount of work when raising the load 7.

Figure 3:
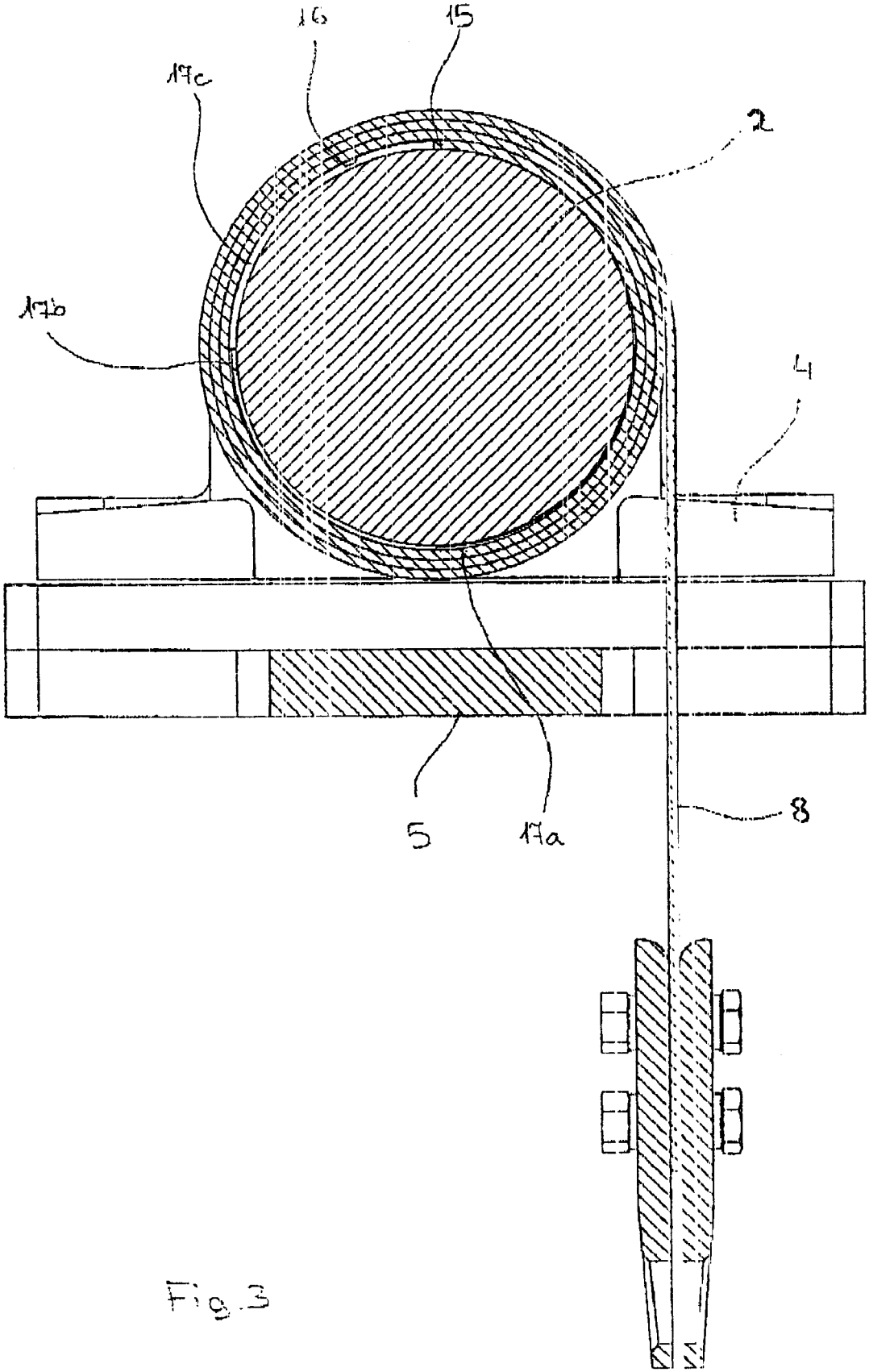
FIG. 3 is a section through the lifting drum of the lifting device of FIGS. 1 and 2.

FIG. 3 shows a section through the lifting drum 2 in that region in which the load-bearing steel belt 8 is wound. In FIG. 3 it can be seen in particular how, when the load 7 is raised (which is not shown in FIG. 3), a plurality of windings of the load-carrying steel belt 8 are wound on top of one another. The steel belt 8 is secured at its upper end, which is identified in FIG. 3 by the reference numeral 15, to the circumferential surface of the lifting drum 2. This may be effected for example by welding, screwing/bolting, riveting, bonding or the like. As long as it is ensured that at no time is the steel belt 8 completely unwound, then the end 15 of the steel belt 8 may also be retained by the windings lying above it.

FIG. 3 clearly shows that, on account of the not negligible thickness of the steel belt 8, an empty space 16 is formed between the lower surface of the first winding and the circumferential surface of the lifting drum 2. In order to prevent the first winding of the steel belt 8 being forced into this empty space 16 under the influence of the load and to avoid a kink being produced in this way at the step formed by the end 15 of the steel belt 8, three circular curved sheet metal pieces 17*a*, 17*b*, 17*c* serving as spacing elements are inserted into this empty space 16. These sheet metal pieces 17*a*, 17*b*, 17*c* have in the illustrated example of implementation a constant thickness, but may also be designed as shaped pieces adapted to the changing distance between the lower side of the first winding of the steel belt 8 and the circumferential surface of the drum 2.

The spacing pieces 17*a*, 17*b*, 17*c* directly impact on one another seen in the circumferential direction. In FIG. 3 their thickness increases in the clockwise direction, i.e. in the direction of the step at the end 15 of the steel belt It can clearly be seen in FIG. 3 how in this way a good bearing surface is formed for the lowermost winding of the steel belt 8, on which all other windings of the steel belt 8 are built up, which prevents excessive bending stresses on the steel belt 8.

In the example of implementation illustrated in FIG. 3 three spacing elements 17*a*, 17*b*, 17*c* are provided. Obviously, depending on requirements, also more or fewer such spacing elements may however be employed, whose number and angular spacing can be determined experimentally so that the lowermost winding of the steel belt 8 is not forced in an unallowable manner into the empty space 16.

Due to the spacing elements 17*a*, 17*b*, 17*c* a premature metal fatigue of the steel belt 8 due to repeated stress reversals is thereby avoided.

Between the lower side of the first winding of the steel belt 14 carrying the counterbalance weight 11 and the circumferential surface of the lifting drum 2 there is obviously arranged in the same way at least one spacing element that ensures a "smooth" course of the first winding of the steel belt 14 on the lifting drum 2.

Figure 4:
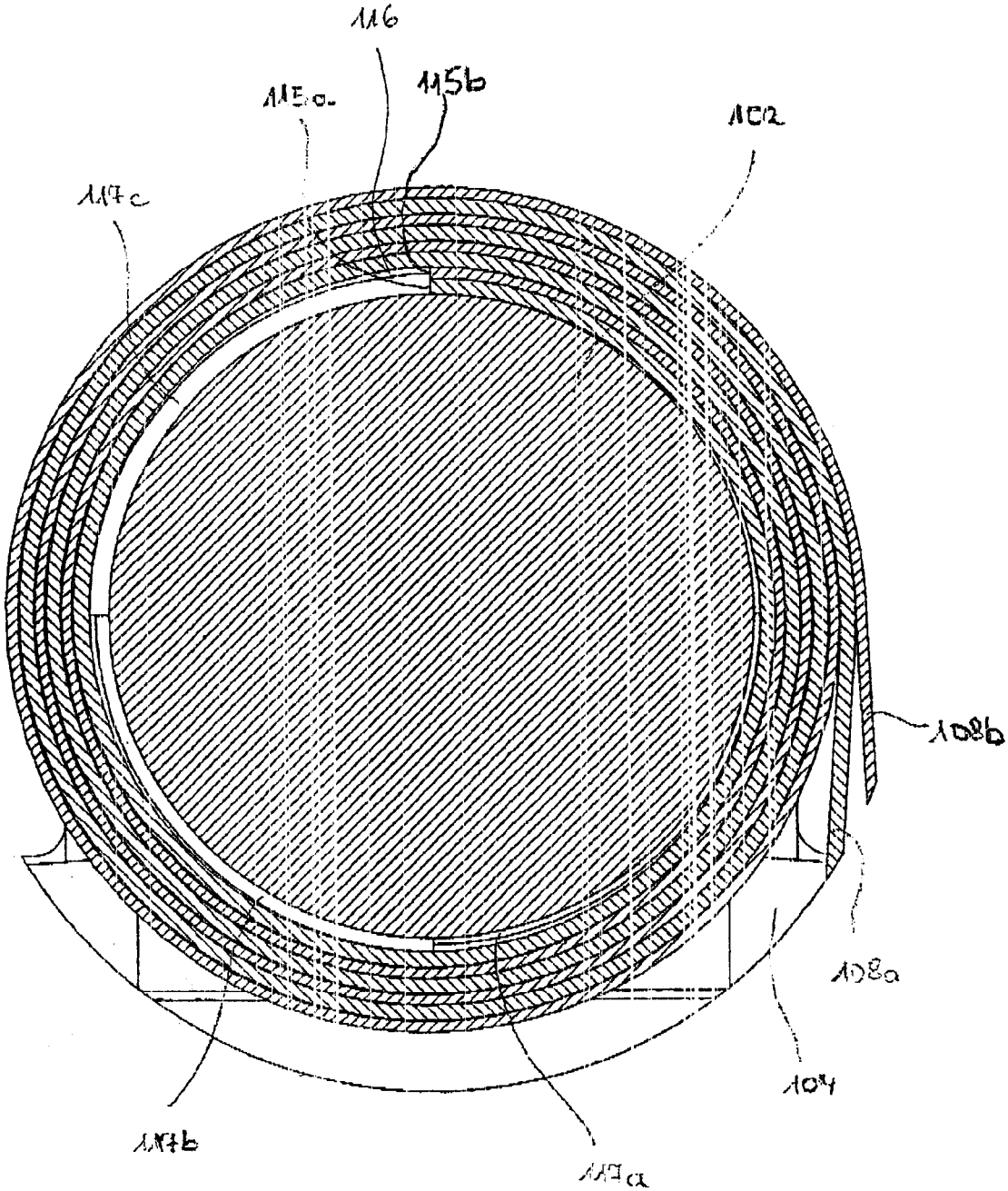
FIG. 4 is a section, similar to FIG. 3, through the lifting drum of a second embodiment of a lifting device.

FIG. 4 shows a section through the lifting drum 102 of a second embodiment of a lifting device. This second example of implementation differs only slightly from the first, described with the aid of FIGS. 1 to 3, so that corresponding parts are identified by the same reference numerals plus 100.

Figure 2:
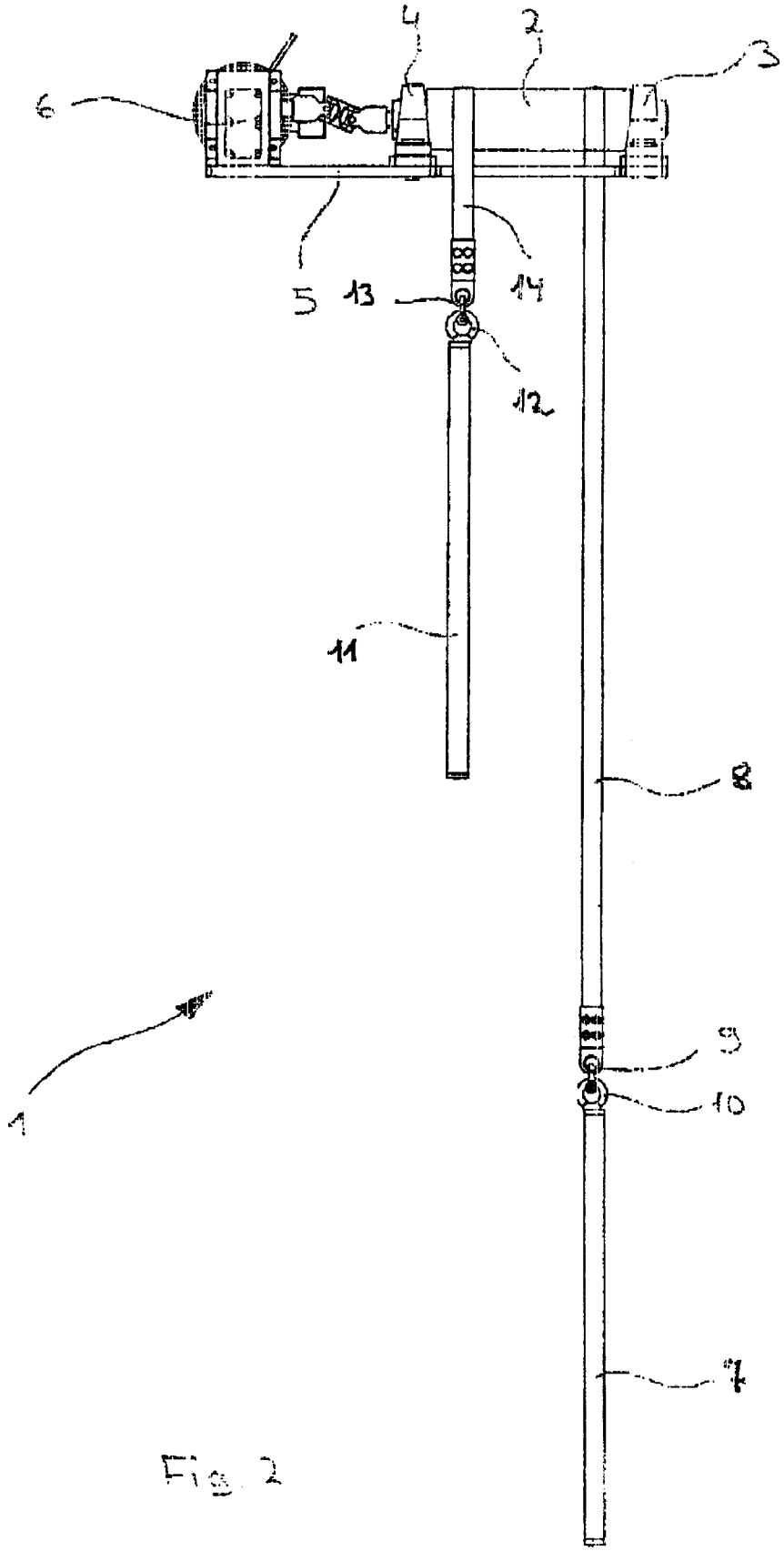
FIG. 2 is a side view of the lifting device of FIG. 1

The main difference between the two examples of implementation is that in the case of the example shown in FIGS. 1 to 3, only a single load-carrying steel belt 8 is used, whereas in the example of implementation of FIG. 4 two steel belts 108*a*, 108*b* are used to reinforce the load-carrying capacity, which belts lie directly on top of one another when they are wound on the lifting drum 202. The upper ends 115*a* and 115*b* of these two steel belts, which are secured to the circumferential surface of the lifting drum 102, form, as can clearly be seen from FIG. 4, a larger step on the circumferential surface of the lifting drum 102 since their thicknesses add together there.

This means that also the empty space 116 between the lowermost winding of the steel belt 108*a* and the circumferential surface of the lifting drum 102 increases. The problem caused thereby is therefore intensified. To overcome this, a total of three spacing elements 117*a*, 117*b*, 117*c* formed as metal sheets are also provided in the example of implementation illustrated in FIG. 4 the said elements directly impacting on one another seen in the circumferential direction of the lifting drum 102. The thickness of the spacing elements 117*a*, 117*b*, 117*c* increases in FIG. 4 again in the clockwise direction, i.e. in the direction of the step at the ends 115*a*, 115*b* of the steel belts 108*a*, 108*b*.

What is claimed is:

1. Lifting device for raising and lowering a load with a lifting drum;

a drive by means of which the lifting drum can be caused to rotate in both directions; and a belt serving as a traction mechanism, which is secured at one end to the lifting drum and at the other end carries a device for holding the load, wherein:

the belt can by rotation of the lifting drum be wound onto the latter so that the windings come to lie on top of one another;

characterised in that at least one spacing element including a thickness is arranged on the circumferential wall of the lifting drum, on which rests the first winding of the belt, wherein the thickness of the at least one spacing element increases in a circumferential direction of the lifting drum that is opposite to the direction of rotation of the lifting drum when raising the load.

2. The lifting device of claim 1, characterised in that the at least one spacing element is a steel sheet.

3. The lifting device of claim 1, characterised in that the belt is made of metal.

4. The lifting device of claim 3 wherein the metal is steel.

5. A lifting device for raising and lowering a load with a lifting drum, a drive by means of which the lifting drum can be caused to rotate in both directions, and at least one belt serving as a traction mechanism, which is secured at one end to the lifting drum and at the other end carries a device for holding the load, wherein the at least one belt can by rotation of the lifting drum be wound onto the latter so that the windings come to lie on top of one another; characterised in that a plurality of spacing elements are arranged next to one another in the circumferential direction of the lifting drum, on which rests the at least one belt, wherein the mean thickness of the plurality of spacing elements increases in that circumferential direction of the lifting drum that is opposite to the direction of rotation of the lifting drum when raising the load.

6. A lifting device for raising and lowering a load with a lifting drum;

a drive by means of which the lifting drum can be caused to rotate in both directions; and, a plurality of belts serving as a traction mechanism, which is secured at one end to the lifting drum and at the other end carries a device for holding the load, wherein:

the plurality of belts capable of being wound on top of one another on the lifting drum; and, characterised in that at least one spacing element is arranged on the circumferential wall of the lifting drum, on which rests the first winding of the plurality of belts.

7. A lifting device for raising and lowering a load with a lifting drum;

a drive by means of which the lifting drum can be caused to rotate in both directions; and at least one load-carrying belt serving as a traction mechanism, which is secured at one end to the lifting drum and at the other end carries a device for holding the load, wherein:

the load-carrying belt can by rotation of the lifting drum be wound onto the latter so that the windings come to lie on top of one another;

and further characterised in that at least one spacing element is arranged on the circumferential wall of the lifting drum, on which rests the first winding of the load-carrying belt; and, a counterbalance weight that is carried by a counterbalance-carrying belt that can be wound in a direction of rotation on the lifting drum that is opposite to the direction of rotation in which the load-carrying belt can be wound on the lifting drum, characterised in that the at least one spacing element is also provided on the circumferential surface of the lifting drum for the counterbalance-carrying belt carrying the counterbalance weight.

* * * * *